US008794171B2

(12) United States Patent
Jauncey

(10) Patent No.: US 8,794,171 B2
(45) Date of Patent: Aug. 5, 2014

(54) BOAT STEERING ARRANGEMENT

(75) Inventor: Paul Frederick Jauncey, Aylesbury (GB)

(73) Assignee: Gobbler Oil Spill Recovery Ltd., Wingrave, Aylesbury, Buckinghamshire (GB)

( * ) Notice: Subject to any disclaimer, the term of this patent is extended or adjusted under 35 U.S.C. 154(b) by 0 days.

(21) Appl. No.: 13/462,850

(22) Filed: May 3, 2012

(65) Prior Publication Data

US 2012/0282827 A1 Nov. 8, 2012

(30) Foreign Application Priority Data

May 3, 2011 (GB) ..... 1107222.0
Oct. 25, 2011 (GB) ..... 1118350.6

(51) Int. Cl.
*B63B 1/22* (2006.01)
*B63H 25/06* (2006.01)
*B63B 39/06* (2006.01)

(52) U.S. Cl.
CPC ..... *B63B 39/06* (2013.01); *B63H 25/06* (2013.01)
USPC ..... 114/285; 114/162; 440/43; 440/61 R; 440/40

(58) Field of Classification Search
USPC ..... 440/61 R, 79; 114/274, 285, 162
See application file for complete search history.

(56) References Cited

U.S. PATENT DOCUMENTS

| | | | | |
|---|---|---|---|---|
| 2,099,492 | A | 11/1937 | Luders | |
| 4,595,372 | A | 6/1986 | Herbert | |
| 4,597,742 | A * | 7/1986 | Finkl | 440/61 R |
| 4,600,395 | A | 7/1986 | Pichl | |
| 4,615,290 | A * | 10/1986 | Hall | 114/150 |
| 4,832,642 | A | 5/1989 | Thompson | |
| 5,326,294 | A * | 7/1994 | Schoell | 440/79 |
| 5,470,262 | A | 11/1995 | Bustillo, Sr. | |
| 6,805,068 | B1 * | 10/2004 | Tossavainen | 114/274 |
| 7,018,252 | B2 * | 3/2006 | Simard et al. | 440/43 |
| 2012/0137947 | A1 * | 6/2012 | Harada et al. | 114/146 |

* cited by examiner

*Primary Examiner* — Lars A Olson
*Assistant Examiner* — Jovon Hayes
(74) *Attorney, Agent, or Firm* — Lewis Brisbois; Bisgaard & Smith LLP; Jon E. Hokanson

(57) ABSTRACT

A boat is provided with a steering arrangement comprising a main steering system and control-surface subsystem. The control-surface subsystem comprises a control-surface assembly attached to the stern of the boat and comprising a trim tab pivotally connected to the stern of the boat, and a skeg rotatably mounted by the trim tab. The control-surface assembly further comprises a trim-tab operating arrangement for pivoting the trim tab, and a skeg operating arrangement. The main steering system and the skeg operating arrangement can be selectively set to operate independently of each other, or in coordination with each other, in steering the boat.

17 Claims, 6 Drawing Sheets

Figure 10
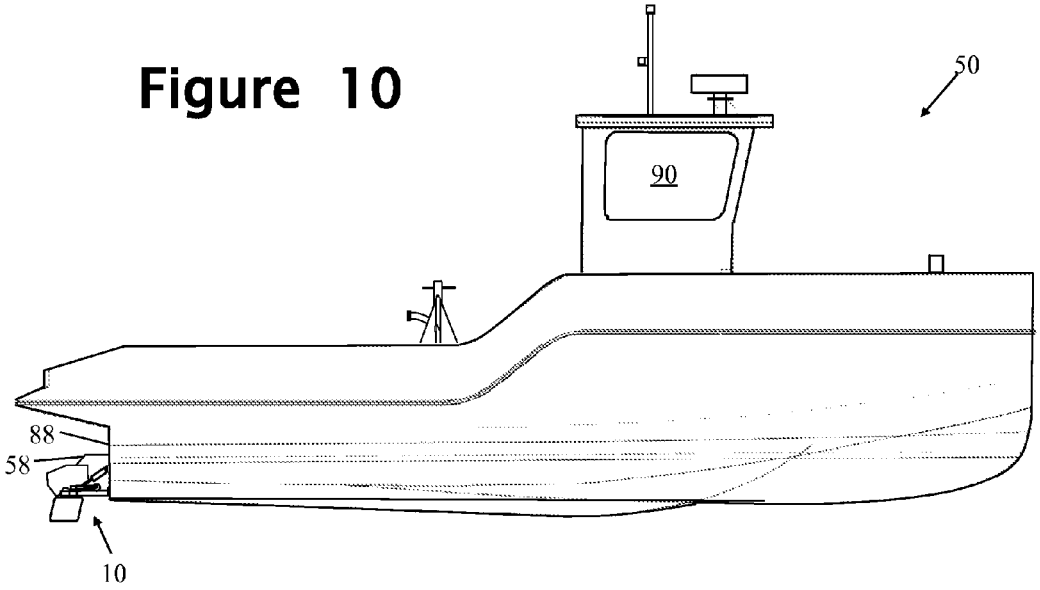
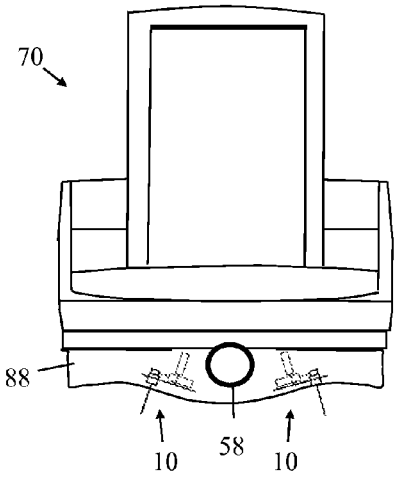
Figure 11
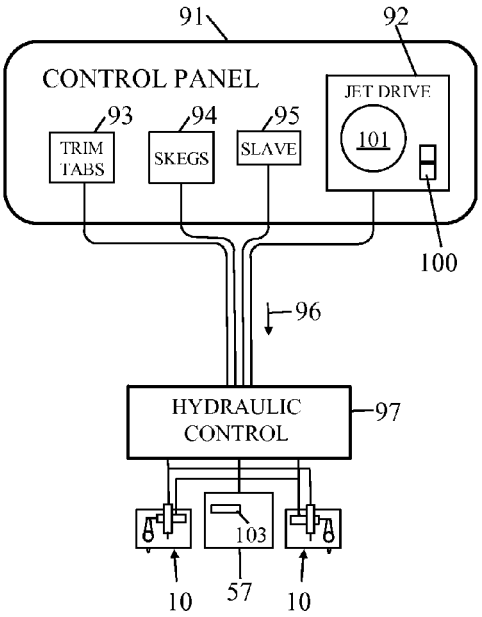
Figure 12

BOAT STEERING ARRANGEMENT

The present application claims the benefits of priority to application GB 1107222.0, filed May 3, 2011, and to application GB 1118350.6, filed Oct. 25, 2011, both of which are incorporated by reference herein.

BACKGROUND

The present invention relates to a boat steering arrangement comprising a main steering system and a control-surface assembly attached to the stern of a boat (that is, any water-borne vessel). Control surfaces of a boat include rudders, hydroplanes and other hinged or movable devices, such as trim tabs, used for controlling the motion of the boat.

As is well known, adjustable trim tabs positioned at the stern of a boat are often used to get the boat to the plane mode as quickly as possible; the boat is then maintained at its most economical cruising speed by tab adjustment. Relative adjustment of port and starboard trim tabs also enables the elimination or reduction of listing or heeling.

More generally, control surfaces may be taken to include static elements such as fixed vertical fins which assist in boat control by, for example, minimizing unwanted lateral movement. Thus, as a means to improve directional stability for watercraft, it is common practice to use fixed underwater fins or 'skegs' at a point as near as possible to the back of the vessel. In general, skegs reduce "side slip" of the vessel when in forward motion. Shallow draft vessels are more prone to side slip than vessels of deeper draft design.

As used herein, the term "skeg" means a fixed or movable vertical control surface; typically, but without limitation, a skeg takes the form of a small vertical fin; in this context, the term "vertical" is used herein to include any inclination that is nearer the true vertical than the true horizontal.

In various situations, it is desirable to provide a boat with movable control surfaces for steering additional to the main steering surfaces. For example, certain types of boat, such as jet drive boats, while being highly manoeuvrable at speed, are difficult to steer at low speed. Also, boats that operate offshore may be required to possess an emergency steering system that is independent of the main steering system.

One way of providing additional steering functionality is to install auxiliary movable vertical control surfaces. However, such control surfaces are potentially vulnerable to damage, particularly where the boat concerned is intended for shallow water operation or for launch and recovery to/from a road trailer.

BRIEF DESCRIPTION OF THE DRAWINGS

Embodiments of the invention will now be described, by way of non-limiting example, with reference to the accompanying diagrammatic drawings, in which:

FIG. 10 is a side elevation of the FIG. 5 oil spill recovery vessel showing one of a pair of oppositely-handed control-surface assemblies of the FIG. 1 form attached to the stern of the vessel and depicted in a neutral position;

FIG. 11 is a stern elevation of the FIG. 10 oil spill recovery vessel showing both of the oppositely-handed control-surface assemblies of the FIG. 1 form attached to the stern of the vessel;

FIG. 12 is a diagram illustrating an integrated control arrangement for the control-surface assemblies and jet drive of the oil spill recovery vessel of FIGS. 10 and 11.

DETAILED DESCRIPTION

Figure 1:
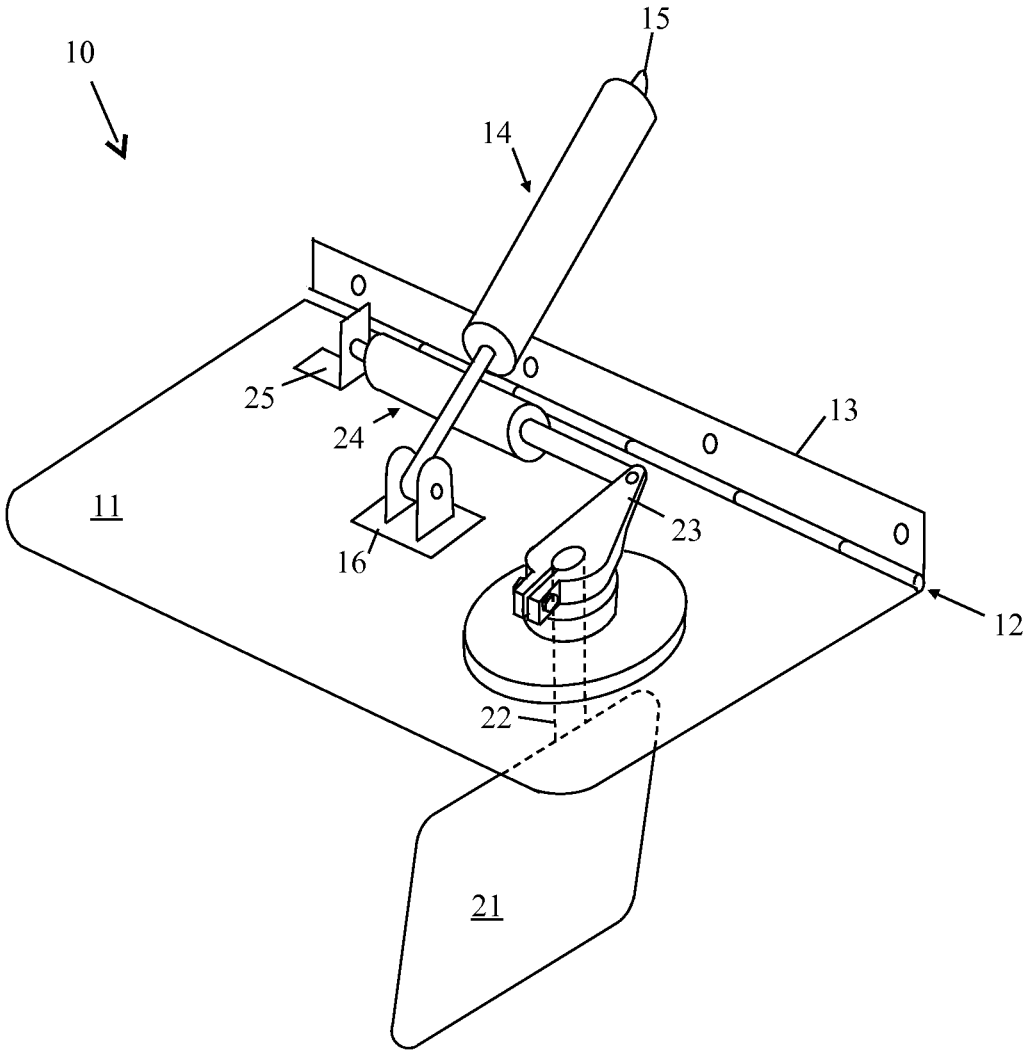
FIG. 1 is a perspective view of a control-surface assembly of an embodiment of the invention.
Figure 2:
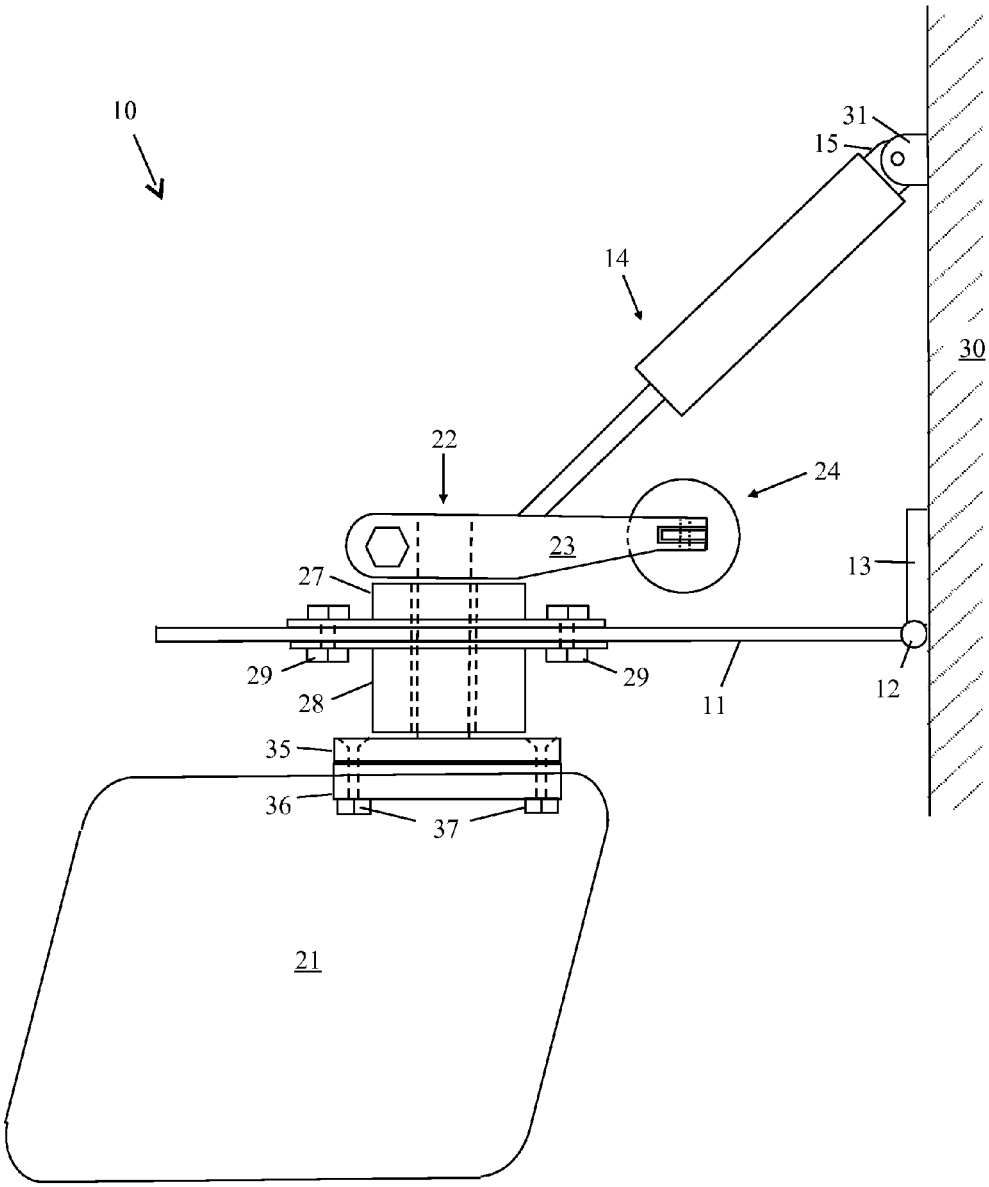
FIG. 2 is a side elevation of the FIG. 1 control-surface assembly shown attached to the stern of a boat.

FIGS. 1 and 2 show an example control-surface assembly 10 for fitting/fitted to the stern of a boat to form part of a control-surface subsystem of the boat.

The control-surface assembly 10 generally comprises a trim tab 11 rotatably mounting a steering control surface formed by skeg 21. The trim tab 11 is arranged to pivot about an axis lying substantially parallel to the plane of the trim tab, the axis being defined in the present embodiment by a hinge 12 that connects the trim tab to a fixing plate 13 intended to be secured to the transom 30 of a boat (for example, by bolts). The angle at which the plate 13 is secured to the boat is such that, for a normally floating boat, the axis about which the trim tab can pivot lies within ±30 degrees of the horizontal and typically near horizontal. The skeg 21 is mounted on the trim tab 11 such that it extends generally at right angles to the trim tab and lies below the latter when the control-surface assembly is fitted to a boat.

As already indicated, the control-surface assembly 10 is intended to form part of a control-surface subsystem for a boat, this subsystem comprising, in addition to the trim tab 11 and skeg 21:

- a trim-tab operating arrangement for pivoting the trim tab 11 about the axis defined by the hinge 12 to selectively raise or lower the trim tab; and
- a skeg operating arrangement for rotating the skeg 21 to enable the latter to be used for steering of the boat.

In the present example, the trim-tab operating arrangement and the skeg operating arrangement comprise respective hydraulic actuators 14 and 24 that are integrated into the control-surface assembly 10. However, in other embodiments the trim-tab operating arrangement and the skeg operating arrangement can be provided inboard of the boat and appropriately connected to operate the trim tab 11 and skeg 21 of the control-surface assembly 10.

Considering next the form of the control-surface assembly 10 in more detail, the trim tab 11 is a plate of any suitable material, dimensions and gauge to suit the size of boat to which it is to be fitted. The trim tab 11 is manufactured to include mounting brackets 16 and 25 for the trim-tab actuator 14 and skeg actuator 24 respectively.

In the present embodiment, the piston rod of the trim-tab actuator 14 is pivotally connected to the mounting bracket 16, and the cylinder of the actuator 14 is provided with an aperture lug 15 to facilitate pivotal connection to a mounting bracket 31 provided on transom 30 (see FIG. 2). With the control-surface assembly 10 fitted to the transom 30 of a boat such that the trim-tab actuator 14 is effective to pivotally raise and lower the trim tab 11.

The blade-like skeg 21 is manufactured from material ideally corrosion resistant to salt water (suitable materials include stainless steel, marine alloy, bronze and FRP) and is sized to give it the strength and effect appropriate to its purpose, described below. The skeg 21 is rigidly attached to a shaft 22 and an aperture of appropriate size to accommodate this shaft is provided in the trim tab 11 offset towards one or other side edge of the trim tab (that is, offset in a direction parallel to the axis of pivoting of the trim tab). The skeg 21 is thus offset towards one or other side edge of the trim tab 11. Depending on the direction of this offset, the control-surface assembly 10 takes on a 'port' or 'starboard' handedness and, generally, rather than a boat being fitted with just a single control-surface assembly, a boat will be fitted with one or more pairs of port and starboard control-surface assemblies 10 with the oppositely-handed assemblies of the or each pair being symmetrically disposed about the boat centreline.

Details of the mounting of the skeg 21 by the trim tab 11 are best seen in FIG. 2.

An upper skeg attachment plate 35 is welded onto the lower end of the skeg shaft 22 and is machined with countersunk holes to accommodate machine bolts 37. A correspondingly apertured lower skeg attachment plate 36 is welded onto the upper edge of the skeg 21. Using bolts 37 and mating nuts the skeg 21 can thus be releasably connected to the shaft 22 enabling the skeg 21 to be replaced should it become damaged.

Upper and lower flanged and centrally-apertured shaft-mounting blocks 27, 28 are positioned on respective sides of the trim tab 11 with their central apertures aligned with the shaft aperture formed in the trim tab; the shaft-mounting blocks 27, 28 are secured together by bolts 29 that pass through the trim tab 11 and the flanges of the blocks.

The skeg shaft 22 extends through the central apertures in the shaft mounting blocks 27, 28 and is held in place, with the upper face of the upper attachment plate 35 juxtaposed the lower face of the lower shaft-mounting block 28, by a tiller arm 23 that is clamped and woodruff keyed (woodruff key not shown) or similar onto the upper end of the shaft 22.

The opposed faces of the lower shaft-mounting block 28 and upper attachment plate 35 are machined smooth and provide a minimum clearance interface that serves to eliminate up/down movement and subsequent banging of the skeg.

The tiller arm 23 is pivotally connected to the rod of the skeg actuator 24 whereby operation of the latter is effective to rotate the skeg 21.

It will be seen from FIG. 2 that the skeg 21 is of parallelogram form with the fore and aft edges angled aft from top to bottom; furthermore, the skeg 21 provides a steering blade of the "balanced type", namely a percentage of the skeg blade is forward of the centreline of the skeg shaft 22, and a proportion of the skeg blade is aft of the centreline of the shaft (a skeg not of the "balanced type" may alternatively be used). As a result, when the skeg 21 is used for steering, the resultant balanced operation gives improved steering in general, and less physical effort required by the vessel helmsman. In the present example, the lower skeg attachment plate 36 is welded to the skeg 21 in such a position that approximately 25% of the skeg blade is forward of the centreline of skeg shaft 22.

Figure 3:
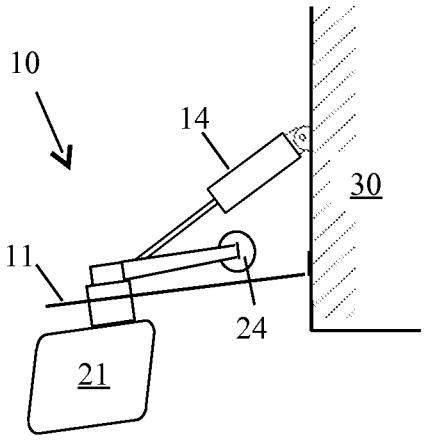
FIG. 3 is a side elevation similar to FIG. 2 but to a reduced scale and showing the control-surface assembly in a lowered position.
Figure 4:
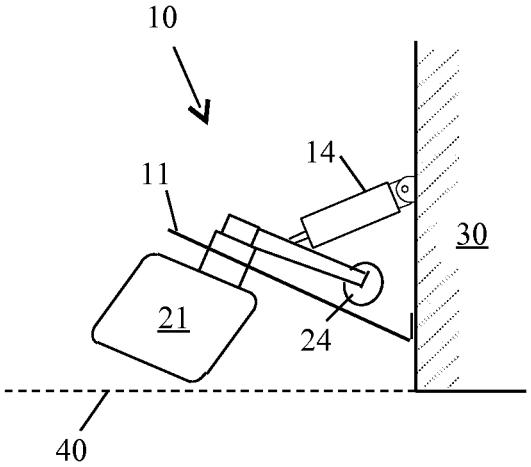
FIG. 4 is a side elevation similar to FIG. 2 but to a reduced scale and showing the control-surface assembly in a raised position.

FIGS. 3 and 4 show the control-surface assembly 10 attached to the transom 30 of a boat and respectively positioned in a fully lowered position and a fully raised position, the raising and lowering being in terms of pivoting of the trim tab 11 and being effected by operation of the trim-tab actuator 14. As can be seen from FIG. 3, when the control-surface assembly 10 is fully lowered, the forward and aft edges of the parallelogram-form skeg 21 are vertical. This arrangement allows a greater working blade area with proportionately more power to the steering process, whilst requiring less physical effort by the helmsman. In addition, by having the leading edge of the skeg vertical (for both forward and reverse movement), the risk a debris being "scooped" up and trapped by the skeg is minimized.

As can be seen from FIG. 4, in the present example when the control-surface assembly 10 is in its fully raised position, the bottom (lowest part) of the skeg 21 lies above the level of the keel of the boat (indicated by dashed line 40) and is therefore substantially protected from damage either in shallow water or as the boat is being launched or recovered from a trailer, mother ship or dockside. Of course, the relative levels of the lowest parts of the skeg 21 and boat when the control-surface assembly 10 is in its fully raised position, will depend on how high up the transom the control-surface assembly 10 is mounted (generally this is set by the required position of the trim tab 11 relative to the boat waterline). However, it will be appreciated that the raising of the skeg 21 resulting from raising of the trim tab 11, will inherently serve to reduce the chance of damage to the skeg 21 either in shallow water or as the boat is being launched or recovered.

An example usage of an oppositely-handed pair of control-surface assemblies 10 in respect of a known form of water jet powered vessel will now be described.

The water jet powered vessel here used as an example vessel to which the control-surface assembly 10 can be usefully applied, is an oil spill recovery vessel, OSRV. The general form of OSRV 50 is shown in FIGS. 5 to 9 and further details can be found in published application GB 2473165 (A), herein incorporated by reference. As illustrated in FIGS. 5 to 9, OSRV 50 comprises a catamaran bow section 51 with twin hulls 81 & 82, and a trimaran main section 52 in which a central hull 80 is interposed between the aft continuations of the twin hulls 81, 82 of the catamaran bow section 12. The triple hulls 80, 81, 82 of the trimaran main section 52 have conjoined upper portions with the depth of this conjoining increasing aftwards whereby to define two flow channels 84, 85 of decreasing cross-sectional area between the hulls (this can be seen with reference to the outline cross-sections of FIGS. 8 and 9 that are taken at the positions depicted by arrows 68 and 69 respectively in FIG. 6, and also with reference to the stern elevation 70 shown in FIG. 7).

A skimmer unit 53 is carried between twin hulls 81 & 82 of the catamaran bow section 51 of the OSRV 50. When the skimmer unit 53 is in a lowered position (shown in chain-dashed outline in FIG. 5), it is arranged to recover oil from an oil spill as the OSRV moves at low speed through the spill; the recovered oil is transferred via pipework 59 to an oil transfer bollard 60 from where it is passed through a transfer hose to a towed bladder attached to the bollard 60 by a towing cable (for simplicity, the transfer hose, towing cable and bladder are not shown in the drawings but arrow 62 in FIG. 6 depicts the direction of oil flow out of the bollard 60 along the hose.)

Figure 5:
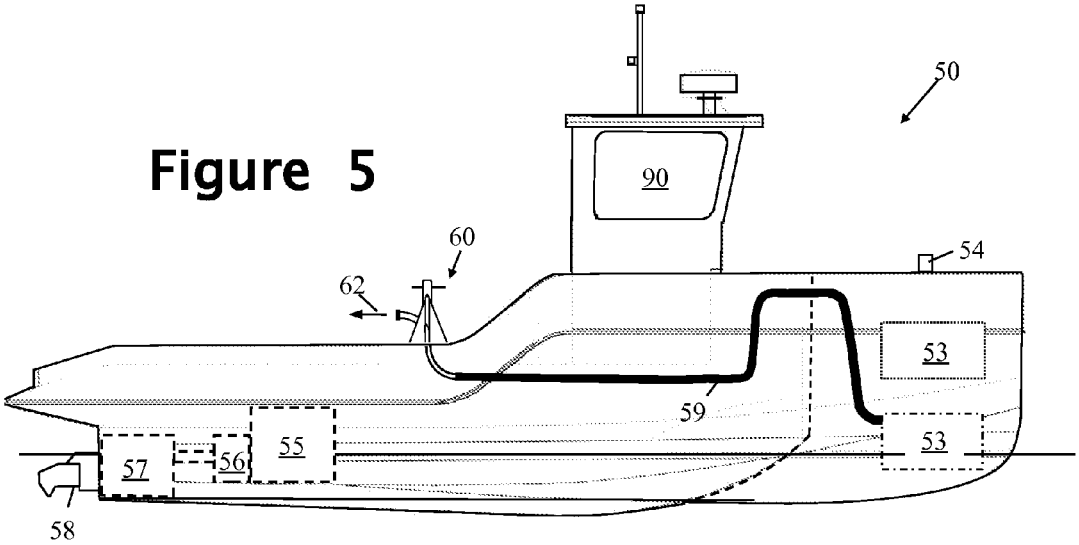
FIG. 5 is a side elevation of a known form of jet-powered oil spill recovery vessel.
Figure 6:
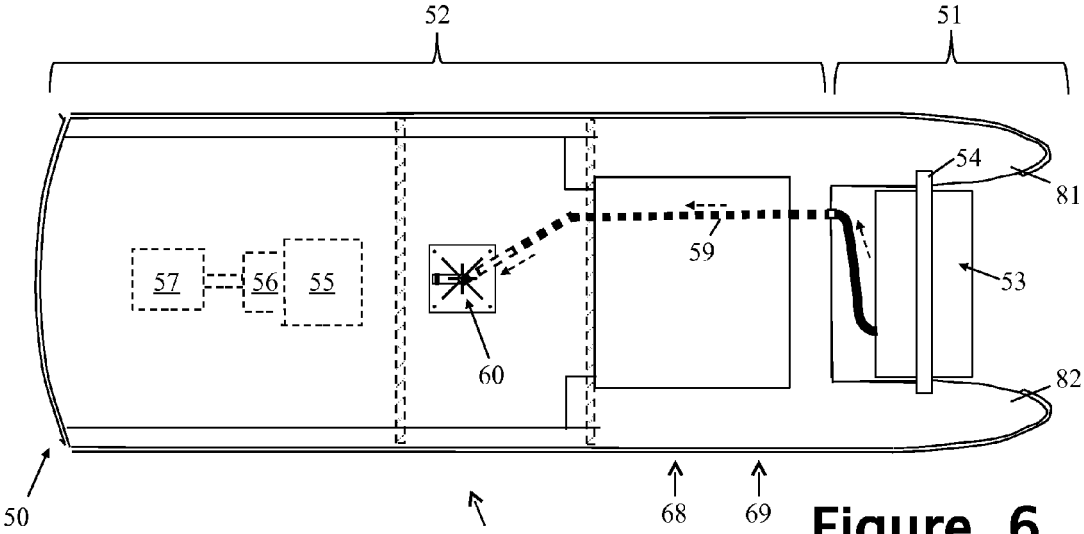
FIG. 6 is a plan view of the FIG. 5 oil spill recovery vessel.

When oil is not being recovered, the skimmer unit 53 can be lifted clear of the water by a lifting mechanism 54 into a raised position (shown in dotted outline in FIG. 5). This enables the OSRV 50 to proceed at a fast speed (for example, 18-20 knots) and thereby minimize transit time to and from an oil spill. When the OSRV 50 is operating at its fast speed, the trimaran section of the vessel will cause it to plane partially lifting the bow section hulls 81, 82 and keeping the wetted areas to a minimum thereby reducing drag.

Figure 7:
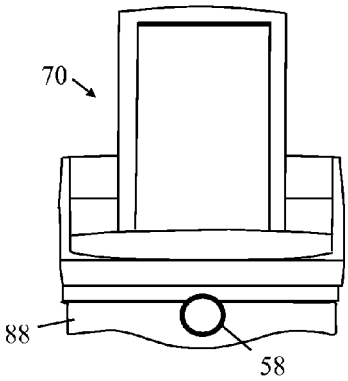
FIG. 7 is a stern elevation of the FIG. 5 oil spill recovery vessel but to a reduced scale relative to FIG. 5.
Figure 8:
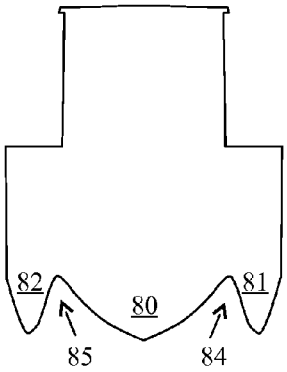
FIG. 8 is a first outline cross-section of the FIG. 5 oil spill recovery vessel but to a reduced scale relative to FIG. 5.
Figure 9:
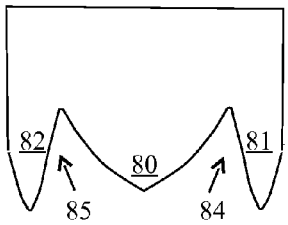
FIG. 9 is a second outline cross-section of the FIG. 5 oil spill recovery vessel but to a reduced scale relative to FIG. 5.

The OSRV propulsion system comprises a water jet drive unit 57 powered from a marine diesel engine 55 via a transmission including a reversible marine gearbox 56. As can be seen in FIG. 7, the outlet 58 of the jet drive unit 57 is centrally positioned in the stern of the OSRV 50. The use of a jet drive is advantageous as it enables the OSRV 50 to carry out skimming operations close inshore and in waterways and harbours.

However, jet-drive vessels, such as OSRV 50, whether pleasure or commercial, are by nature less manoeuvrable than their shaft driven inboard engine counterparts This is because a jet drive unit is positioned approximately at water level on the transom of a vessel, and steered by use of a steering control surface formed by a deflector plate situated within the water jet tube of the jet drive unit and operative to deflect the high pressure water jet in the desired direction (movement of the deflector plate being controlled by an actuator in dependence on operation of a user-operable steering control such as a steering wheel or port/starboard toggle switch). In contrast, a steering system comprising a normal propeller and rudder combination has the advantage of the rudder being positioned directly aft of the propeller whereby the water flow from the propeller is deflected in the desired direction but at a greater depth than a surface mounted jet-drive unit. Such propeller installations with rudders, be they single or multiple, provide a more powerful medium for vessel steerage than a jet drive.

From an operational point of view, it will be appreciated that ideally the jet-powered OSRV 50 should be highly manoeuvrable at slow speed for skimming, while providing good high speed planing control.

To enable these criteria to be satisfied, the transom 88 of OSRV 50 is fitted with a pair of oppositely-handed control-surface assemblies 10 as illustrated in FIGS. 10 and 11. The two assemblies 10 are disposed symmetrically about the jet drive outlet 58 with the skeg 21 of each assembly located outboard of the fore/aft centre line of the corresponding trim tab 11. Each assembly is fitted such that its trim tab follows the line of the dead-rise (or similar) of the central hull 80.

The OSRV 50 thus has an overall steering arrangement comprising both the main steering system (formed by the jet deflector plate, its associated actuator and the steering control) and a skeg-based steering system provided by the control-surface subsystem (the control-surface assemblies and their associated actuators and control).

FIG. 12 diagrammatically depicts an example overall control arrangement for the jet drive unit 57 and the control-surface subsystem; in the present example, the control arrangement is a hybrid electrical/hydraulic arrangement with its user-operable controls located in the wheelhouse of the OSRV. More particularly, a control panel 91 is provided in the wheelhouse for controlling the trim tabs 11, the skegs 21 and the jet drive 57. The control panel 91 provides electrical control signals (indicated by arrow 96) to a hydraulic control unit 97 located near the stern of the vessel, the unit 97 being operative to translate the electrical signals from the control panel 91 into corresponding hydraulic signals to the trim-tab actuators 14, the skeg actuators 24 and power and steering actuators of the jet drive 57.

The following controls are provided on the control panel 91:

- jet drive control 92 comprising a throttle control 100 for controlling the power of the jet drive, and a user-operable steering control wheel 101 (or other element) for steering the water jet (the main steering system of the OSRV 50 thus comprises the steering control wheel 101, actuator 103 for moving the jet deflector plate of the jet drive unit 57, and the jet deflector plate itself);
- trim-tab control 93 selectively enabling the independent or coordinated lowering and raising of the trim tabs 11 by controlled operation of the actuators 14;
- skeg steering control 94 for controlling rotation of the skegs 21 by controlled operation of the actuators 24 (the skeg-based steering system thus comprises the control 94, the actuators 24 and the skegs 21); and
- a slave control 95 which selectively operatively couples or isolates the operation of the skeg steering control 94 and the steering control 101 of the jet drive control 92 whereby the skegs 21 can be selectively set to rotate in correspondence to the steering of the water jet of the jet drive 57, or to operate independently of the steering of the jet drive 57.

The slave control 95 thus enables the skegs 21 to be set to operate (through their respective operating arrangements, in this example the actuators 24) selectively either in coordination with, or independently of, the main steering system of the OSRV in steering the boat. Once the slave control 95 has been set in a selected state, coordinated or independent operation of the skegs and main steering system (as the case may be) continues until the set state of the slave control is changed.

As already noted, the FIG. 12 control arrangement is a hybrid electrical/hydraulic arrangement. It will, however be appreciated that the control arrangement can use any suitable form of control circuit for controlling the skegs and main steering system such as, for example, an entirely hydraulic system, an entirely electrical system (including electrical actuators, such as electric motors), an entirely mechanical system (such as one using Bowden cables or other cable system), or a hybrid hydraulic and/or electrical and/or mechanical system. Control signals can be passed to actuators in any suitable form including analog and digital forms and can physically be sent in many different ways including as optical signals over optical cables. Whatever the precise nature of the control technology employed in any particular case, it can be seen that the general nature of the FIG. 12 control arrangement is that the main steering system and the skeg operating arrangement effectively comprise respective control circuits that can be selectively:

- isolated from each other to set the main steering system and the skeg operating arrangement for independent operation,
- operatively coupled together to set the main steering system and the skeg operating arrangement for coordinated operation.

In the specific case of the FIG. 12 control arrangement, it is, of course, the slave control 95 that provides the capability of isolating or operatively coupling the control circuits of the main steering system and the skeg operating arrangement.

The trim tabs 11 and skegs 21 of the control-surface assemblies 10 fitted to the OSRV 50 are advantageously put to use as described below during operation use of the OSRV 50.

During high speed transit of the OSRV to an oil spill, the trim tabs 21 are set independently or in a coordinated manner in accordance with vessel load and the prevailing sea-state in order to maintain vessel trim for maximum safety, comfort and economy. During such high speed transit, the skegs 21 are set in a straight fore/aft direction to aid forward motion directional stability.

For low speed work such as oil skimming, steerage of the OSRV 50 is improved relative to jet drive steering alone, by coordinated steering operation of the skegs 21, possibly slaved to the steering control of the jet drive 57 to provide tighter and faster course changes. The skegs 21 may also be individually controlled for fine steering control.

Furthermore, as the skegs 21 can be operated independently of the main steering system of the OSRV (the jet drive steering system), the skegs 21 can be used (typically, in coordination) as an emergency steering system in the event of the failure of the vessel main steering system.

As a result of the skegs 21 being mounted on the trim tabs 11, the directional stabilizing effect of the skegs can be varied by lowering/raising the trim tabs 11. Of course, as already noted, the ability to raise the skegs 21 by operation of the trim tabs 11 enables the skegs to be put in a less vulnerable position for shallow water operation and for launch and recovery operations (from a road trailer, ship, dockside, or oil/gas platform). Furthermore, in locations which are dangerous, (for example, in the tropics where crocodiles, leeches etc may be present) or where debris is problematic and could become entrapped around the skegs 21 during commercial/pleasure operations, raising the trim tabs 11 enables the skegs to be raised for cleaning without the need for the vessel operator to enter the water.

Figure 13:
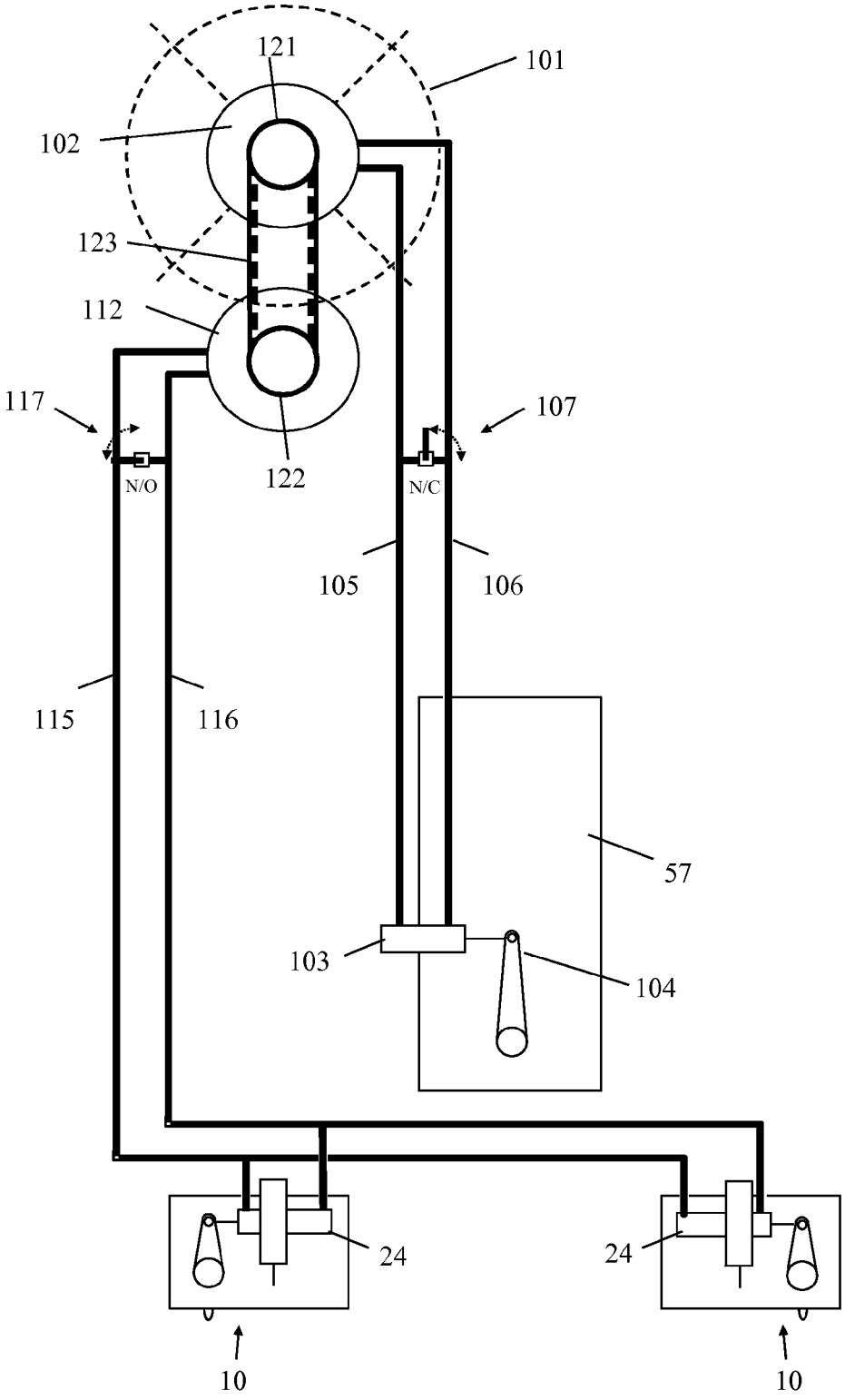
FIG. 13 is a diagram illustrating an integrated hydraulic steering control arrangement for the control-surface assemblies and jet drive of the oil spill recovery vessel of FIGS. 10 and 11.

FIG. 13 depicts an alternative arrangement to that of FIG. 12 for implementing steering control through the main steering system and the skegs 21 of the control-surface assemblies 10. The FIG. 13 steering control arrangement is hydraulic-based rather than being an electrical/hydraulic hybrid as in FIG. 12; also, a common user-operable steering control (the steering wheel 101) is used to control both the main steering system and the skeg-based steering system.

In the FIG. 13 steering control arrangement, the steering control wheel 101 (shown dashed) of the main steering system is arranged to effect proportionate control of the deflector plate of the jet drive unit 57 through double-acting hydraulic actuator 103 and steering arm 104, the latter being rigid with a rotatably mounted axle to which the deflector plate is attached within the unit 57. Proportional control of the hydraulic actuator 103 by the wheel 101 is effected by means of an hydraulic helm pump 102 that has its rotor shaft connected to the shaft of the wheel 101 such that rotation of the wheel causes a proportional displacement of hydraulic fluid through hydraulic lines 105, 106 connected to opposite sides of the double acting hydraulic actuator 103; the flow of hydraulic fluid in lines 105, 106 is oppositely directed, the direction in any one line being dependent on the which way the wheel 101 is turned. The lines 105, 106 are bridged by a normally-closed (N/C) bypass valve 107 that can be opened to short circuit hydraulic control of the actuator 103 and thereby disengage the main steering system. The valve 107 is, for example, arranged for local manual operation though remote operation, for example, through wire, electrical or hydraulic means, can additionally/alternatively be provided.

A second helm pump 112 is provided for effecting proportional control of the skeg actuators 24 from the wheel 101 through hydraulic lines 115, 116. The helm pump 112 is coupled to the wheel 101 through toothed pulleys 121, 122 secured to the rotor shafts of the helm pumps 102, 112 respectively, and a toothed belt 123 that is engaged around both toothed pulleys 121, 122. The lines 115, 116 are bridged by a normally-open (N/O) bypass valve 117 whereby hydraulic control of the actuators 24 is normally disabled and the skegs 21 disengaged from control by the wheel 101; on closure of the valve 117, the lines 115, 116 are no longer short circuited and the skegs are proportionately controlled by the steering wheel 101. The valve 117 is, for example, arranged for local manual operation though remote operation, for example, through wire, electrical or hydraulic means, can additionally/alternatively be provided.

The helm pumps 102, 112 may be power assisted or manual.

During normal operation, the valve 107 is closed and the valve 117 open as a result of which the main steering system (jet drive deflector plate) is engaged whereas the skegs 21 are disengaged from control by the wheel 101 thereby disabling the steering system provided by the skegs. However, should it be desired to provide additional steering control, the valve 117 can be closed thereby enabling control of the skegs by the wheel 101, this control being in coordination with the control of the jet-drive deflector plate due to the coupling of the shafts of the helm pumps. It will, of course, be appreciated that for the skegs to provide steering control of the vessel, the trim tabs need to be in their lowered position. In the event of a problem with the jet drive steering, control of the deflector plate by the wheel 101 can be disengaged by opening the valve 107; assuming the valve 117 is closed and the trim tabs are down, steering is now effected through control of the skegs by the wheel 101 alone.

If both valves 107 and 117 are open, then both main steering system and the skeg steering system are disabled. This can be used as a security measure for the vessel, particularly if the operating mechanisms for the valves are concealed.

It should be noted that generally it is desirable for the jet-drive deflector plate to be set to lie straight fore and aft before disabling the main steering system by switching the valve 107 from its closed to its opened position. Similarly, it is desirable for the skegs 21 to be set to lie straight fore and aft before disabling the skeg steering system by switching the valve 117 from its closed to its opened position. However, even if this is not done, the jet-drive deflector plate/skegs should self align with the water flow therepast due to water flow pressure on the jet-drive deflector plate/skegs and the fact that hydraulic fluid is free to circulate through the valve 107/117 between the lines of the corresponding hydraulic circuit.

It will be appreciated that, although as described the FIG. 13 control arrangement is substantially an entirely hydraulic system (apart from the mechanical coupling of the helm pumps), the general form of the FIG. 13 control arrangement can be applied to not only to an entirely hydraulic system, but also to an entirely electrical system, an entirely mechanical system, or any suitable hybrid hydraulic and/or electrical and/or mechanical system. Control signals can be passed to actuators in any suitable form including analog and digital forms and can physically be sent in many different ways including as optical signals over optical cables. Whatever the precise nature of the control technology employed in any particular case, it can be seen that the general nature of the FIG. 13 control arrangement is that a common user-operated steering control element is arranged to be set to control a selected one of: the main steering system; the skeg steering system; and both the main steering system and the skeg steering system operating in coordination with each other. More specifically, the main steering system and the skeg steering system comprise respective control circuits that each employ the common user-operated steering control element for effecting steering control (thereby ensuring their coordinated operation when both are enabled). The control circuits of the main steering system and the skeg steering system are arranged to be individually and selectively capable of being disabled by a user. As a result, the user-operated steering control element can be set to control a selected one of: the main steering system, the skeg steering system, and both the main steering system and the skeg steering system operating in coordination with each other. In the specific case of the FIG. 13 control arrangement, it is, of course, the mechanical coupling of the helm pumps that enables the wheel 101 to form the steering control element of the hydraulic control circuits of both the main steering system and the skeg steering system; the individual and selective disablement of the hydraulic control circuits is achieved through the valves 107 and 117.

Although the use and operation of the control-surface assembly 10 has been described above in relation the fitting of an oppositely-handed pair of assemblies 10 to a water jet powered vessel, it will be appreciated that the number of control-surface assemblies fitted to a vessel can range from one to any number as desired. Furthermore, the type of vessel to which a control-surface assembly or assemblies 10 can be fitted and controlled as described above, is not limited to water jet powered vessels and generally any type of vessel (including propeller driven vessels with rudder-based main steering systems) can be provided with one or more control-surface assemblies 10 an their associate control arrangements.

Many variants are possible to the above described form of control-surface assembly 10. For example, the skeg 21 can be centrally mounted in the trim tab 11 rather than being offset towards one side edge and the details of how the skeg is rotatably mounted by the trim tab can be varied, as will be apparent to a person skilled in the art. Furthermore, it is possible to provide multiple skegs 21 rotatably mounted on the trim tab for coordinated operation by the skeg actuator 24.

The placement and form of the trim-tab actuators 14 and skeg actuators 24 can be varied from that described; for example, rotary actuators can be used rather than linear actuators and the actuators can be electrically powered rather than hydraulic. As already indicated, rather than operating the trim tab 11 and skeg 21 using actuators that are part of the control-surface assembly 10, trim-tab and skeg operating arrangements can be provided that are mounted inboard of the boat to which the assembly 10 is fitted, the trim tab 11 and skeg 21 being, for example, connected to such operating arrangements by wire or other form of connection.

The shapes of the trim tab 11 and skeg 21 can be varied from that shown and the axis of pivoting of the trim tab 11 may be offset out of the plane of the trim tab.

The control-surface assembly can be made independently of a boat and later fitted to a boat; alternatively, the control-surface assembly can be built in situ on a boat (including, for example, by fitting a skeg to existing trim tab).

The invention claimed is:

1. A boat having a transom extending along a transom plane and provided with a steering arrangement comprising:

a main steering system with a steering control surface through which it operates to steer the boat, and a control-surface subsystem comprising:

a control-surface assembly attached to the stern of the boat and comprising;

a trim tab pivotally connected to the stern of the boat, said trim tab adapted to pivot from +30 degrees to −30 degrees about a trim tab axis extending along and substantially parallel to the transom plane, and;

a skeg rotatably mounted on the trim tab, located below the trim tab and adapted to pivot about a skeg axis extending perpendicular to the transom plane;

a trim-tab operating arrangement for pivoting the trim tab about said trim tab axis whereby to selectively raise or lower the trim tab; and a skeg operating arrangement for rotating the skeg about said skeg axis to at least assist in steering of the boat; and, the main steering system and the skeg operating arrangement being selectively settable to:

operable independently of each other in steering the boat; and, operate in coordination with each other in steering the boat.

2. A boat according to claim 1, wherein the main steering system and the skeg operating arrangement comprise respective control circuits that can be selectively:

isolated from each other to set the main steering system and the skeg operating arrangement for independent operating, operatively coupled together to set the main steering system and the skeg operating arrangement for coordinated operation.

3. A boat according to claim 1, wherein the steering arrangement included a user-operated steering control element selectively settable to control:

the main steering system;

the skeg operating arrangement;

both the main steering system and the skeg operating arrangement in coordination with each other.

4. A boat according to claim 3, wherein the main steering system and skeg operating arrangement comprise respective control circuits each including the user-operated steering control element for effecting steering control; the control circuits of the main steering system and the skeg operating arrangement each being arranged for selective disablement by a user whereby to set the user-operated steering control element to control a selected one of: the main steering system and the skeg operating arrangement operating in connection with each other.

5. A boat according to claim 3, wherein:

the main steering system and the skeg operating arrangement comprised respective hydraulic helm pumps coupled for coordinated operation from the user-operable steering control element;

the helm pumps of the main steering system and the skeg operating arrangement are hydraulically coupled through respective hydraulic circuits to hydraulic actuators of the main steering system and the skeg operating arrangement respectively, and the hydraulic circuits of the main steering system and the skeg operating arrangement each include a respective valve arrangement for selectively disabling the main steering system and the skeg operating arrangement respectively.

6. A boat according to claim 5, wherein the helm pumps are coupled for coordinated operation by means of respective toothed pulleys fixed to rotor shafts of the helm pumps and a toothed belt that engages around both pulleys.

7. A boat according to claim 3, wherein the user-operated steering control element is further selectively settable to control:

neither of the main steering system and the skeg operating arrangement.

8. A boat according to claim 7, wherein the steering control surface of any of said main steering system and skeg operating arrangement that the steering control element is not arranged to control, is arranged to be self aligning with water flow therepast.

9. A boat according to claim 1, wherein:

the skeg operating arrangement comprises a skeg actuation mounted on the trim tab and arranged to rotate the skeg;

the skeg actuator is a linear actuator with first and second elements linearly movable relative to each other, the first element being connected to the trim tab, the skeg is provided with a shaft, rigid with the skeg, which rotatably engages in a mount carried by the trim tab, the shaft extending through the trim tab via the mount, and the shaft is connected, on the opposite side of the trim tab to the skeg, with an arm coupled to the second element of the linear actuator, whereby operation of the skeg linear actuator causes rotation of the skeg.

10. A boat according to claim 1, wherein the boat further comprises a water jet propulsion unit including a deflector plate for deflecting the water jet from the water jet propulsion system, the deflector plate of the water jet propulsion unit comprising said steering control surface of the main steering system; the water jet propulsion unit being arranged to power the boat both for high-speed planning in which planning control is effected by trim-tab adjustment and the skeg is kept centralized, ad for low speed operation in which the skeg is controlled by the skeg operating arrangement to at least assist in steering of the boat.

11. A boat according to claim 10, wherein:

the jet outlet of the water jet propulsion unit is centrally positioned in the stern of the boat; and the steering arrangement includes two said control-surface assemblies attached to the stern of the boat and symmetrically disposed about the centreline of the boat, each said control-surface assembly having a respective associated said trim-tab operating arrangement and skeg-operating arrangement.

12. A boat according to claim 11, wherein the skeg-operating arrangements of the two control surface assemblies are selectively operable in coordination with, or independently of, each other.

13. A boat according to claim 11, wherein for each control-surface assembly, in a fully raised position of its trim tab, the lowest part of its skeg is higher than the bottom of the stern of the boat.

14. A boat provided with a steering arrangement comprising:

a user-operated steering control element;

a main steering system comprising a steering control surface, and a hydraulic actuator for operating the steering control surface, and a control-surface subsystem comprising:

a control-surface assembly attached to the stern of the boat and comprising a trim tab pivotally connected to the stern of the boat, and a skeg rotatably mounted by the trim tab such that the skeg is located below the trim tab;

a trim-tab operating arrangement for pivoting the trim tab; and a skeg operating arrangement comprising a hydraulic actuator for rotating the skeg to at least assist in steering of the boat;

wherein:

the main steering system and the skeg operating arrangement further comprise respective hydraulic helm pumps coupled for coordinated operation from the user-operable steering control element;

the helm pumps of the main steering system and the skeg operating arrangements are hydraulically coupled through respective hydraulic circuits to the hydraulic actuators of the main steering system and the skeg operating arrangement respectively, and the hydraulic circuits of the main steering system and the skeg operating arrangement each include a respective valve arrangement for selectively disabling the main steering system and the skeg operating arrangement respectively;

whereby, through appropriate setting of said valve arrangements, the user-operated steering control element can be set to control a selected one of the main steering system, the skeg operating arrangement, and both the main steering system and the skeg operating arrangement in coordination with each other.

15. A boat according to claim 14 including a water jet propulsion unit whose jet outlet is centrally positioned in the stern, the main steering system comprising a deflector plate for deflecting the water jet from the water jet propulsion system.

16. A boat provided with a steering arrangement comprising:

a main steering system, and control-surface subsystem;

the control-surface subsystem comprising:

a control-surface assembly attached to the stern of the boat and comprising:

a trim tab pivotally connected to a hinge attached to the stern of the boat, adapted to rotate up and down in relation to the boat; and, a skeg rotatably mounted to the trim tab, extending below the trim tab and adapted to rotate left and right about an axis of rotation;

a trim-tab operating arrangement for pivoting the trim tab; and a skeg operating arrangement;

wherein the main steering system and the skeg operating arrangement are selectively settable to operate independently of each other, or in coordination with each other, in steering the boat.

17. A boat including a propulsion system, a transom, a main steering system and an additional steering system comprising:

said additional steering system comprising:

a trim tab rotatably mounted on said transom and having a horizontal axis of rotation with respect to a normally floating boat;

a skeg rotatably mounted on said trim tab and having a vertical axis of rotation with respect to a normally floating boat;

a trim tab actuator mounted to said transom, mounted to said trim tab and operatively adapted to pivotally raise and lower said trim tab about said horizontal axis of rotation; and, a skeg actuator mounted to said trim tab, rigidly attached to said skeg and operatively adapted to rotate said skeg about said vertical axis of rotation and to assist steering of said boat.

* * * * *